US008017855B2

(12) United States Patent
Cremer et al.

(10) Patent No.: US 8,017,855 B2
(45) Date of Patent: Sep. 13, 2011

(54) APPARATUS AND METHOD FOR CONVERTING AN INFORMATION SIGNAL TO A SPECTRAL REPRESENTATION WITH VARIABLE RESOLUTION

(75) Inventors: Markus Cremer, Berkeley, CA (US); Claas Derboven, Ilmenau (DE); Sebastian Streich, Barcelona (ES)

(73) Assignee: Fraunhofer-Gesellschaft zur Foerderung der Angewandten Forschung E.V., Munich (DE)

( * ) Notice: Subject to any disclaimer, the term of this patent is extended or adjusted under 35 U.S.C. 154(b) by 797 days.

(21) Appl. No.: 11/629,594

(22) PCT Filed: Apr. 27, 2005

(86) PCT No.: PCT/EP2005/004518

§ 371 (c)(1),
(2), (4) Date: Apr. 8, 2008

(87) PCT Pub. No.: WO2005/122135

PCT Pub. Date: Dec. 22, 2005

(65) Prior Publication Data

US 2009/0100990 A1 Apr. 23, 2009

(30) Foreign Application Priority Data

Jun. 14, 2004 (DE) ..... 10 2004 028 694

(51) Int. Cl.
*G10H 1/00* (2006.01)

(52) U.S. Cl. ..... 84/623; 84/603; 84/608; 84/615

(58) Field of Classification Search ..... 84/623
See application file for complete search history.

(56) References Cited

U.S. PATENT DOCUMENTS

| | | | |
|---|---|---|---|
| 4,142,433 | A | 3/1979 | Gross |
| 4,184,401 | A | 1/1980 | Hiyoshi et al. |
| 4,354,418 | A | 10/1982 | Moravec et al. |
| 4,397,209 | A | 8/1983 | Deforeit |

(Continued)

FOREIGN PATENT DOCUMENTS

| | | |
|---|---|---|
| EP | 1278182 | 1/2003 |

(Continued)

OTHER PUBLICATIONS

"Parallel Japanese Office Action mailed Mar. 9, 2010".

(Continued)

*Primary Examiner* — Elvin G Enad
*Assistant Examiner* — Christopher Uhlir
(74) *Attorney, Agent, or Firm* — Dicke, Billig & Czaja, PLLC

(57) ABSTRACT

The apparatus for converting an information signal from a time to a variable spectral representation includes a means for windowing the information signal, a means for converting the windowed information signal to a spectral representation, and a means for weighting a set of information signal spectral coefficients with several sets of complex base function coefficients provided from a means for providing the sets of base function coefficients. The sets of base function coefficients are derived from base functions of various frequencies by windowing and transform, wherein several sets of base function coefficients are provided for one and the same base function for base functions of higher frequencies, wherein the windows for providing these sets are related to various time portions of the base function. The variable spectral representation exhibits variable bandwidth of the variable spectral coefficients, which are efficient and accurate to calculate and especially suited for music analysis purposes.

22 Claims, 6 Drawing Sheets

U.S. PATENT DOCUMENTS

| | | | | | |
|---|---|---|---|---|---|
| 4,633,749 | A | * | 1/1987 | Fujimori et al. | 84/607 |
| 4,841,828 | A | * | 6/1989 | Suzuki | 84/601 |
| 5,117,727 | A | | 6/1992 | Matsuda | |
| 5,260,980 | A | | 11/1993 | Akagiri et al. | |
| 5,392,231 | A | | 2/1995 | Takahashi | |
| 5,442,129 | A | | 8/1995 | Mohrlok et al. | |
| 5,459,281 | A | | 10/1995 | Shibukawa | |
| 5,475,629 | A | | 12/1995 | Takahashi | |
| 5,756,918 | A | | 5/1998 | Funaki | |
| 5,760,325 | A | | 6/1998 | Aoki | |
| 6,057,502 | A | | 5/2000 | Fujishima | |
| 6,111,181 | A | * | 8/2000 | Macon et al. | 84/603 |
| 6,111,183 | A | * | 8/2000 | Lindemann | 84/633 |
| 2003/0182105 | A1 | * | 9/2003 | Sall et al. | 704/206 |

FOREIGN PATENT DOCUMENTS

| | | | |
|---|---|---|---|
| JP | H01-219634 | | 9/1989 |
| JP | H02-029792 | | 1/1990 |
| JP | 02188794 | | 7/1990 |
| JP | 04104617 | | 4/1992 |
| JP | 05216482 | A | 8/1993 |
| JP | 05346783 | | 12/1993 |
| JP | 2000097759 | | 4/2000 |
| JP | 2000-298475 | | 10/2000 |
| JP | 2003156480 | | 5/2003 |
| JP | 2003263155 | | 9/2003 |
| WO | 01/04870 | A1 | 1/2001 |
| WO | 01/88900 | | 11/2001 |

OTHER PUBLICATIONS

Japanese Office Action mailed Feb. 17, 2010.

"Calculation of a Constant Q Spectral Transform" Judith C. Brown, Journal of the Acoustical Society of America, 89(1), Seiten 425, 432 Jan. 1991.

"Curtis Road: Computer Musical Tutorial", Part 4, Sound Analysis (6 pgs.).

"An Efficient Algorithm of the Calculation of a Constant Q Transform," Judith C. Brown, u.a., Journal of the Acoustical Society of America, 92 (5), Seiten 2698-2701, Nov. 1992.

"High Resolution Spectral Analysis with Arbitrary Spectral Centers and Arbitrary Spectral Resolutions," F.J. Harris, Computer Electr. Eng. 3, Seiten 171-191, 1976.

"Harmonic Wavelets, Constant Q Transforms and the cone kernel TFD," Proceedings of the Spie—The International Society for Optical Engineering, 1996 SPIE-INT. Soc. Opt. Eng USA, Bd. 2762, 12. Apr. 1996 Seiten 446-451, XP002345889 Orlando, FL, USA.

"Proceedings of the 1999 International Computer Music Conference", Tsinghua University, et al., ICMC Proceedings, 1999.

"To Catch a Chorus: Using Chroma-based Representatios for Audio Thumbnailing", Mark A. Bartsch, et al., IEEE Workshop on Applications of Signal Processing to Audio and Acoustics, Oct. 21-24, 2001.

"Recognition of Musical Tonality from Sound Input", Ozgur Izmirli, et al., IEEE 1994.

"Computationally Inexpensive and Effective Scheme for Automatic Transcription of Polyphonic Music", Weilun Lao, et al., IEEE 2004.

"Music Key Detection for Musical Audio", Yongwei Zhu, et al., Proceedings of the 11th International Multimedia Modelling Conference, IEEE 2005.

"Efficient Pitch Detection Techniques for Interactive Music", Patricio de la Cuadra, et al., Center for Research in Music and Acoustics, Stanford University.

"Computation of Spectrawith Unequal Resolution Using the Fast Fourier Transform", Alan Oppenheim, et al., Princeton University.

"High Precision Fourier Analysis of Sounds using Signal Derivatives", Myriam Desainte-Catherine, et al. May 1, 1998.

"Automatic Musical Genre Classification of Audio Signals", George Tzanetakis, et al., Computer Science Dept., Princeton University.

"A Probabilistic Expert System for Automatic Musical Accompaniment", Christopher Raphael, Journal of Computational and Graphical Statistics, vol. 10, Nov. 3, 2001, pp. 487-512.

* cited by examiner

FIGURE 2

| VARIABLE SC $SC_i = [2^{1/12}] \cdot 46$ Hz | CONSTANT SC $\Delta f = 2{,}74$ Hz |
|---|---|
| 46.0 | 46.0 |
| 48.74 | 48.74 |
| 51.63 | 51.48 |
| 54.7 | 54.22 |
| 58.0 | 56.96 |
| 61.04 | 59.7 |
| 65.1 | 62.44 |
| 68.9 | 65.18 |
| 73.02 | 67.92 |
| 77.36 | 70.66 |
| 81.96 | 73.40 |
| 86.84 | 76.14 |
| 92.0 | 78.88 |

APPARATUS AND METHOD FOR CONVERTING AN INFORMATION SIGNAL TO A SPECTRAL REPRESENTATION WITH VARIABLE RESOLUTION

CROSS-REFERENCE TO RELATED APPLICATIONS

This Utility Patent Application claims the benefit of the filing date of German Application No. DE 10 2004 028 694.9 filed Jun. 14, 2004, and International Application No. PCT/EP2005/004518 filed Apr. 27, 2005, both of which are herein incorporated by reference.

FIELD OF THE INVENTION

The present invention relates to information signal processing and particularly to audio signal processing for the purpose of polyphonic music analysis or polyphonic music transcription.

BACKGROUND

The variety of musical presentations and the number of tastes in music of the audience have grown equally in the last few years. In particular, the interest in music is growing in the population due to the rapid advances in storing and further distributing pieces of music. Thus, the digital storage has made it possible to copy pieces of music as often as one likes without loss in quality. The most prominent example for this is the CD, which has almost completely superseded records. Recently, DVDs are also becoming increasingly popular, since they do not only enable the presentation of stereo music, but also multi-channel music, i.e. the known 5.1 surround format, for example.

Previously, the main focus was on the improvement of the sound quality and in the improvement of the distribution methods. But the increasing expansion of the Internet and digital broadcasting has been accompanied by new demands for a pre-filtering of the large amounts of music data available for the individual people. In this connection, the metadata concept, i.e. providing data via music data, reaches a new dimension. While descriptive data previously have been generated manually and added to the corresponding piece of music, automatic means to objectively analyze the content of a piece of music are being developed. Standardization methods in this field are known by the keyword "MPEG-7".

Thus, achievements of this music analysis are to be seen in an efficient music summary or in a format-independent association of metadata with pieces of music. An objective of the automatic generation of metadata also consists in the ability to extract features from the original content, which are related to the taste in music of the user. For example, it is known to use extracted features of pieces of music to train a music provision system in that it categorizes incoming music into different musical genres.

In order to specify the musical content in manageable and yet searchable manner, i.e. in order to provide data that can be read and interpreted both by humans and by machines, reference has to be made to semantically meaningful properties of the audio signal. Such properties are the tone of instruments, the melody contained in a piece, the tempo, the rhythm, or the harmony of a piece, for example. In this connection, particularly the harmony feature is of special significance, since its importance is meaningful as an indicator for a mood of a musical passage. A piece is perceived differently in terms of feeling by a listener, depending on whether it is dissonant or harmonic, or whether it is written in a major key or in a minor key. At the same time, the harmony gives hints to the structural diversity of the available music material, for example whether there are quick and unusual chord changes, or whether there are repetitive properties in the chord structure.

The automatic expansion of polyphonic notes to full chords is known from musical tone synthesis. Modern synthesizers and keyboards are capable of automatically accompanying a player by analyzing their playing in real time and by generating a bass accompaniment, for example. The rules employed by such synthesizers or keyboards may also be applied to notes recovered from polyphonic music, even if not all notes can be recovered yet due to technical imperfections, in order to finally find dominant chords in an examined piece of music.

Thus, it is one object to analyze pieces of music not already present in musical notation or as a MIDI file, but present in form or their acoustic/electric waveforms, in order to extract individual notes from the examined piece of music due to waveform present in the time domain. The objective hereof lies in the melodic transcription of polyphonic music, i.e. ultimately the generation of a complete musical notation from a time domain representation of the music, which ultimately is a series of samples, as it is stored on a CD, for example, or is present in an mp3 file in compressed/encoded manner, for example.

A musical notation of a piece of music may in a way be considered a frequency domain representation, since the piece of music is not given by a waveform in the time domain but by a series of notes or chords, i.e. several concurrent notes, which is written in the frequency domain, with the note lines here being the frequency range scale.

At the same time, a musical notation also includes, however, time information in that a note is to be played either longer or shorter due to its symbol. The musical notation does therefore not place too much importance on a pure frequency domain representation, i.e. the representation of an amplitude at a special frequency, even though amplitude information is also given. This information is, however, not specified, but generally as information, whether a portion of the piece of music, i.e. some bars or notes of a musical notation, for example, are to be played loudly (forte) or quietly (piano).

In classical music, in particular, but also in modern music, it can be assumed that—apart from percussive portions—all notes/tones lie in a predefined note raster. Thus, in a correctly played piece of music not all frequencies can be present, but only the frequencies permitted by the musical notation. In the western note scale, one octave is divided into twelve halftones. These twelve halftones are, however, not arranged at a constant spacing—with reference to the frequency. Instead, in the tempered mood, as it is known due to the "Well-Tempered Clavier" by Johann Sebastian Bach, for example, a sequence of tones is employed, which is such that the "quality" or the "Q factor" is constant for each tone. This means that a frequency value divided by the bandwidth associated with this frequency value is constant for every tone. Tones with low frequencies have small bandwidths, whereas tones with high frequencies have great bandwidths.

This "geometric" notes classification is exemplarily illustrated in FIG. 2 in the left column. The calculation rule starting from a certain minimum frequency, which has arbitrarily been assumed as 46 Hz in the example shown in FIG. 2, is shown in the left upper field of FIG. 2. It can be seen that the spacing between the tone with 46.0 Hz and the tone with 48.74 Hz, which is 2.74 Hz, is smaller than the spacing between the tone at 92.0 Hz and the tone at 86.84 Hz, which is 5.16 Hz.

These spectral coefficients also referred to as variable spectral coefficients in the classification shown in the left half of FIG. 2 thus are different from so-called constant spectral coefficients, as they are illustrated in the right half of FIG. 2.

In the constant spectral coefficients, the spacing between two spectral coefficients at the lower end of the spectrum to the upper end of the spectrum is always the same. For illustration purposes, the twelve tones in FIG. 2 are illustrated in the tempered arrangement on the left in FIG. 2 on the one hand, and in a constant arrangement with a frequency spacing of 2.74 Hz in the right column on the other hand. While the frequency spacing becomes greater and greater in the left column so that the quality of each variable spectral coefficient is equal, the quality of each constant spectral coefficient in the right column increases more and more with increasing frequency due to the growing frequency value, because the frequency spacing is identical.

From the above discussion, it becomes obvious that constant spectral coefficients, as they are provided by a Fourier transform, for example, are in contrast at least with the western sense of music.

But since a transcription is to be created from a piece of music, as a first step to a harmony analysis, often no Fourier transform but a so-called constant Q transform is employed, i.e. a transform taking into account that the quality of each variable spectral coefficient is identical. This leads to the fact that the transform is supposed to provide a frequency raster, which is no constant frequency raster, as it is shown on the right in FIG. 2, but that this transform provides a variable frequency raster, as it is shown on the left in FIG. 2. In other words, a variable transform is supposed to adapt the frequency raster, as it is shown on the left in FIG. 2, to the well-tempered note scale, for example, as forms the basis of an overwhelming number of classical and popular pieces of music.

In the technical publication "Calculation of a Constant Q Spectral Transform", Judith, C. Brown, Journal of the Acoustical Society of America, 89 (1), pages 425-432, January 1991, a time-frequency conversion is shown, which takes into account that the scale of western music is based on a geometric spectral coefficient spacing. Such a constant Q transform may be derived from a Fourier transform, in which the logarithm is taken of the frequency axis. This "pattern" in the frequency domain is the same for all music signals with harmonic frequency components. But differences manifest themselves in the amplitudes of the components in spite of their relatively fixed positions. These amplitude differences give the tone its tone color, for example.

When the frequency axis is illustrated logarithmically, it turns out that the mapping of constant spectral coefficients to variable spectral coefficients provides too little information at low frequencies and too much information at high frequencies. The discrete short-time Fourier transform gives a constant resolution for every frequency bin, which is inversely proportional to the temporal window size. This means that a window with 1,024 samples at a sampling rate of 32,000 samples per second has a resolution of 31.3 Hz. At the lower end of a violin, for example, i.e. at the frequency $G_3$ of 196 Hz, this resolution is 16% of the frequency. This is much greater than a 6% frequency separation for two adjacent notes, which are tuned to the same mood. At the upper end of a piano, the frequency of $C_8$ is 4186 Hz, wherein the FFT resolution of 31.3 Hz leads to a resolution value of 0.7% of the center frequency. Thus, much too great a number of frequency coefficients is calculated by the FFT at this point in the frequency range. Mathematically, the constant Q transform is represented as follows:

$$X[k] = \sum_{n=o}^{N-1} W[k, n]x[n]\exp\{-j2\pi Qn/N[k]\}.$$

In this equation x[n] is the n-th sample of a digitized time function to be analyzed. The digital frequency is 2 πk/N. The period in samples is N/k, and the number of analyzed cycles is equal to k. Here, W[n] indicates the window shape. The window function has the same shape for each component. Its length is, however, determined by N[k], so that it is a function of k and n.

In the technical publication "An Efficient Algorithm for the Calculation of a Constant Q Transform", Judith C. Brown et al., Journal of the Acoustical Society of America, 92 (5), pages 2698-2701, November 1992, an efficient algorithm for calculating the previously described transform is given. At first a discrete Fourier transform is determined, which is then converted to a constant Q transform, wherein Q is the ratio of center frequency to the bandwidth. To this end, so-called kernels are calculated, which then are applied to each consecutive DFT. Thus, each component of the constant Q transform can be calculated with a few multiplications. A spectral kernel is the discrete Fourier transform of a temporal kernel, wherein a temporal kernel is given as follows:

$$w[n, k_{cq}]e^{-j\omega_{k?}^{n}} = K*[n, k_{cq}].$$

$$x^{cq}[k_{cq}] = \sum_{n=o}^{N-1} x[n]K*[n, k_{cq}]$$

As window w[n,k], a Hamming window according to the following definition is used:

$$w[n,k_{cq}]=a-(1-a)\cos(2\pi n/N[k_{cq}]),$$

In this equation, α equals 25/46.

In F. J. Harris, "High-Resolution Spectral Analysis with Arbitrary Spectral Centers and Arbitrary Spectral Resolutions", "Comput. Electr. Eng. 3", pages 171-191, 1976, a transform with bounded Q value is used, which may also serve for music analysis. Here, at first a fast transform is calculated, in order to then again discard the frequency values with the exception of the topmost octave. Then, it is filtered, downsampled by a factor of 2, in order to finally calculate a further FFT with the same amount of points as before, which leads to twice the previous resolution. Of this result, again only the second-highest octave is retained. Then, this procedure is repeated until the lowest octave is reached. The advantage of this method is that the efficiency of the FFT is maintained, and that at the same time a variable frequency and a variable time resolution are obtained, so that one is capable of optimizing the obtained information both with respect to the frequency and with respect to the time.

It is disadvantageous in this concept that, when a larger tone space is to be calculated, nevertheless a large amount of Fourier transforms is to be calculated, wherein between each Fourier transform windowing (filtering) has to be performed anew and at the same time downsampling has to be done. This in turn means that for the lowest octave very many temporal samples are needed, whereas very few temporal samples are needed for the topmost octave. Thus, if one wishes to calculate a complete analysis, for every (small) number of samples for the topmost octave the entire pyramid, so to speak, has to be calculated through. Since most results of each FFT are further "thrown away" in this method, and since a rather significant number of overlaps with respect to the lower octaves is required in the temporal "pyramid", this method is extremely intensive, in spite of using the indeed efficient FFT. In other words, for each octave an FFT of its own has to be calculated to obtain a complete spectrum. If one wishes to analyze a time signal completely, i.e. for example every 8 milliseconds or every 16 milliseconds, in case for example 6 octaves are to be calculated, as many as 96 (!) FFTs will be required for an excerpt of a piece of 128 milliseconds.

SUMMARY

One embodiment of the present invention provides a more efficient concept for converting an audio signal to a spectral representation with variable spectral coefficients.

In accordance with a first aspect, the present invention provides an apparatus for converting an information signal, which is given as a series of samples, to a spectral representation with variable spectral coefficients, with a frequency value and a bandwidth being associated with a variable spectral coefficient, and with a frequency spacing of the variable spectral coefficients being variable, having: a window filter for windowing the information signal to obtain a windowed block of the information signal having a length in time; a converter for converting the windowed block of samples to a spectral representation having a set of information signal spectral coefficients; a provider for providing a first set of complex base function coefficients, a second set of complex base function coefficients and a third set of complex base function coefficients, wherein the base function coefficients of the first set represent a result of a first windowing and transform of a first base function, which has a frequency corresponding to a first frequency value of a first variable spectral coefficient, wherein the base function coefficients of the second set represent a result of a second windowing and transform of a second base function, which has a frequency corresponding to a second frequency value of a second variable spectral coefficient, and wherein the base function coefficients of the third set represent a result of a third windowing and transform of the second base function, which has the second frequency value, wherein the first windowing, the second windowing and the third windowing differ in that a window length of a window in the first windowing differs from a window length of a window in the second and the third windowing, and that a window position of the second window and of the third window differ with reference to the second base function; and a weighter for weighting the set of information signal spectral coefficients with the first set of base function coefficients, in order to calculate the first variable spectral coefficient, for weighting the set of information signal spectral coefficients with the second set of base function coefficients, in order to obtain the second variable spectral coefficient for a first portion of the windowed block of the information signal, and for weighting the set of information signal spectral coefficients with the third set of base function coefficients, in order to obtain the second variable spectral coefficient for a second portion of the windowed block of the information signal, which is different from the first portion of the windowed block of the information signal.

In accordance with a second aspect, the present invention provides an apparatus for providing sets of base function coefficients, having: a provider for providing a time representation of a first and a second base function, wherein the first base function has a first frequency value, and wherein the second base function has a second frequency value, which is higher than the first frequency value; a window filter for windowing the first base function with a first window and for windowing the second base function with a second window and a third window, wherein the third window relates to a portion of the second base function later in time than the second window; and a transformer for transforming a result of a windowing of the first base function with the first window, in order to obtain a first set of base function coefficients, for transforming a result of a windowing of the second base function with the second window, in order to obtain a second set of base function coefficients, and for windowing a result of a third windowing of the second base function with the third window, in order to obtain a third set of base function coefficients.

In accordance with a third aspect, the present invention provides a method of converting an information signal, which is given as a series of samples, to a spectral representation with variable spectral coefficients, with a frequency value and a bandwidth being associated with a variable spectral coefficient, and with a frequency spacing of the variable spectral coefficients being variable, with the steps of: windowing the information signal to obtain a windowed block of the information signal having a length in time; converting the windowed block of samples to a spectral representation having a set of information signal spectral coefficients; providing a first set of complex base function coefficients, a second set of complex base function coefficients and a third set of complex base function coefficients, wherein the base function coefficients of the first set represent a result of a first windowing and transform of a first base function, which has a frequency corresponding to a first frequency value of a first variable spectral coefficient, wherein the base function coefficients of the second set represent a result of a second windowing and transform of a second base function, which has a frequency corresponding to a second frequency value of a second variable spectral coefficient, and wherein the base function coefficients of the third set represent a result of a third windowing and transform of the second base function, which has the second frequency value, wherein the first windowing, the second windowing and the third windowing differ in that a window length of a window in the first windowing differs from a window length of a window in the second and the third windowing, and that a window position of the second window and of the third window differ with reference to the second base function; and weighting the set of information signal spectral coefficients with the first set of base function coefficients, in order to calculate the first variable spectral coefficient, weighting the set of information signal spectral coefficients with the second set of base function coefficients, in order to obtain the second variable spectral coefficient for a first portion of the windowed block of the information signal, and weighting the set of information signal spectral coefficients with the third set of base function coefficients, in order to obtain the second variable spectral coefficient for a second portion of the windowed block of the information signal, which is different from the first portion of the windowed block of the information signal.

In accordance with a fourth aspect, the present invention provides a method of providing sets of base function coefficients, with the steps of: providing a time representation of a first and a second base function, wherein the first base function has a first frequency value, and wherein the second base function has a second frequency value, which is higher than the first frequency value; windowing the first base function with a first window and windowing the second base function with a second window and a third window, wherein the third window relates to a portion of the second base function later in time than the second window; and transforming a result of a windowing of the first base function with the first window, in order to obtain a first set of base function coefficients, transforming a result of a windowing of the second base function with the second window, in order to obtain a second set of base function coefficients, and windowing a result of a third windowing of the second base function with the third window, in order to obtain a third set of base function coefficients.

In accordance with a fifth aspect, the present invention provides a computer program with a program code for performing, when the computer program is executed on a computer, a method of converting an information signal, which is given as a series of samples, to a spectral representation with variable spectral coefficients, with a frequency value and a bandwidth being associated with a variable spectral coefficient, and with a frequency spacing of the variable spectral coefficients being variable, with the steps of: windowing the information signal to obtain a windowed block of the information signal having a length in time; converting the windowed block of samples to a spectral representation having a set of information signal spectral coefficients; providing a first set of complex base function coefficients, a second set of complex base function coefficients and a third set of complex base function coefficients, wherein the base function coefficients of the first set represent a result of a first windowing and transform of a first base function, which has a frequency corresponding to a first frequency value of a first variable spectral coefficient, wherein the base function coefficients of the second set represent a result of a second windowing and transform of a second base function, which has a frequency corresponding to a second frequency value of a second variable spectral coefficient, and wherein the base function coefficients of the third set represent a result of a third windowing and transform of the second base function, which has the second frequency value, wherein the first windowing, the second windowing and the third windowing differ in that a window length of a window in the first windowing differs from a window length of a window in the second and the third windowing, and that a window position of the second window and of the third window differ with reference to the second base function; and weighting the set of information signal spectral coefficients with the first set of base function coefficients, in order to calculate the first variable spectral coefficient, weighting the set of information signal spectral coefficients with the second set of base function coefficients, in order to obtain the second variable spectral coefficient for a first portion of the windowed block of the information signal, and weighting the set of information signal spectral coefficients with the third set of base function coefficients, in order to obtain the second variable spectral coefficient for a second portion of the windowed block of the information signal, which is different from the first portion of the windowed block of the information signal.

In accordance with a sixth aspect, the present invention provides a computer program with a program code for performing, when the computer program is executed on a computer, a method of providing sets of base function coefficients, with the steps of: providing a time representation of a first and a second base function, wherein the first base function has a first frequency value, and wherein the second base function has a second frequency value, which is higher than the first frequency value; windowing the first base function with a first window and windowing the second base function with a second window and a third window, wherein the third window relates to a portion of the second base function later in time than the second window; and transforming a result of a windowing of the first base function with the first window, in order to obtain a first set of base function coefficients, transforming a result of a windowing of the second base function with the second window, in order to obtain a second set of base function coefficients, and windowing a result of a third windowing of the second base function with the third window, in order to obtain a third set of base function coefficients.

The present invention is based on the finding that a transform to a spectral representation with variable spectral coefficients may be understood as a correlation of the music signal with the sought frequency raster in which the variable spectral coefficients are. A correlation of a signal with a frequency raster may be understood as a search for how much proportion is contained in the audio signal, which is contained in the frequency band associated with a variable spectral coefficient. A correlation of the audio signal with a sine tone as an example for a base function yields the content of the audio signal at the frequency of the base tone. The conversion to a variable spectral representation hence may be achieved by correlation of the audio signal with a base function, with each base function being a time representation of a variable spectral coefficient in the variable spectral representation. If this correlation is understood as a convolution, this correlation may be understood as a convolution of the audio signal with every single base function.

According to the invention, this calculation is, however, not performed in the time domain but in the frequency domain. To this end, the audio signal itself is at first windowed to obtain a windowed block of the audio signal, wherein the windowed block of the audio signal has a predetermined temporal length. Hereupon, the windowed block of samples is converted to a spectral representation comprising a set of spectral coefficients, which preferably are constant spectral coefficients, as they are obtained by a preferably employed computation-efficient FFT, for example. This single calculated FFT spectrum of the audio signal is now subjected to a correlation with base functions, the base functions having different frequency values. For example, if variable spectral coefficients are sought in spectral coefficients at 46.0 Hz and 48.74 Hz, one base function is a sine function at 46.0 Hz and the other base function is a sine function with 48.74 Hz. Both base functions start with a defined phase with respect to each other and preferably with the same phase. Both base functions then are windowed and transformed, with the window length with which the base function is transformed setting the bandwidth this variable spectral coefficient has in the final variable spectral representation. The base function spectral coefficients obtained by a base function are also referred to as set of base function coefficients. The convolution in the time domain for correlation purposes is simply performed by a multiplication of the FFT spectrum by the base function coefficients in the frequency domain. At the end of this multiplication by the base function coefficients, there results a value the amplitude of which shows, how much signal energy is contained in the audio signal at the frequency of the base function, with the frequency value of the variable spectral coefficient obtained therewith being given by the frequency value of the base function.

As has been set forth, the window for windowing the base function, in order to obtain the base function coefficients, sets the bandwidth of the variable spectral coefficients. For higher variable frequency values, i.e. for higher musical tones, the bandwidth does not have to be as small as for low tones any more. For this reason, the set of base function coefficients for a higher tone is obtained by the base function being windowed with a shorter window and then transformed to obtain the base function coefficients for the higher tone. The variable spectral coefficient for this higher tone is then again obtained by weighting the original FFT spectrum with the set of base function coefficients.

According to the invention, it is advantageously taken advantage of the fact that for higher tones the window of the base function, which has a higher frequency, is shorter than a window for windowing a base function having a lower frequency. It is analyzed for a temporally later portion of the audio signal, which has in a way been windowed after the window with which the second base function (representing a higher tone than the first base function) has been windowed. To this end, the same second base function (for the higher tone) is windowed with a window lying temporally after the window with which the second base function has been windowed at first. The base function coefficients obtained thereby are then weighted with the same Fourier spectrum, in order to obtain a variable spectral coefficient having the same frequency as the variable spectral coefficient just calculated, but which includes the content of the audio signal at the frequency sought, namely following in time to the region calculated previously in the audio signal. According to the invention, this is achieved by using complex base function coefficients as base function coefficients, which develop by windowing and transforming the base function. Thereby, it is achieved that audio signal regions within the window are taken into account, wherein the originally calculated audio signal spectrum also preferably is a complex spectrum.

In a preferred embodiment of the present invention, the window length of a window for determining the base function coefficients for a lower frequency value is chosen, according to an integer multiple to the window length, for windowing a base function for a higher tone, wherein the integer multiple preferably is a multiple of 2. With this, all sets of base function coefficients may efficiently be sorted into a matrix, so that transforming the constant spectral representation to the variable spectral representation may be obtained as a simple matrix-vector multiplication, which is extraordinarily efficient to execute, wherein the vector is the result of the constant spectral transform of the audio signal, and wherein the matrix includes a set of base function coefficients in each line.

At this point it is to be pointed out, in particular, that the matrix is a very thinly populated matrix, since—in the ideal case—the set of base function coefficients only has a single base function coefficient, namely at the frequency of the sought tone. But since the windows for windowing a base function typically are not of such resolution, so as to accurately resolve a frequency value of a variable spectral coefficient. Furthermore, by the not phase-correct windowing of the base function, also additional spectral lines are generated, which is to be attributed to the fact that a base function enters the window with a certain phase and exits the window for windowing the base function with a certain phase. Moreover, the rectangular windowing preferably used, which is very efficient numerically because no weighting like with other windows is to be performed, leads to artifacts, which lead to additional spectral lines next to the actual spectral line at the frequency of the base function.

Depending on the implementation, the base function coefficients may be calculated directly. It is, however, preferred to calculate the base function coefficients off-line, i.e. sometime for a certain temporal length of the base function window or for a certain sampling rate, and store the same in a matrix, wherein this weighting matrix may then be filed in a working memory of a processor when calculating the variable spectral representation or when "transforming" the constant spectral representation to the variable spectral representation.

In a preferred embodiment, the number of base function coefficients in a set of base function coefficients is limited. Here, it is preferred to use as many base function coefficients in weighting the constant spectrum that the base function coefficients used carry a certain percentage of the overall energy contained in a window for windowing a base function. If this percentage is set higher toward 100%, the spectral analysis becomes more accurate. But if this percentage is set further away from 100%, the number of base function coefficients necessary for weighting is reduced, which shows itself in a more efficient and quicker weighting. Thus, the matrix of the base function coefficients inherently is a thinly populated matrix, wherein the thin population of this matrix may be "thinned" further by setting the percentage further away from 100%, so that certain algorithms for handling very thinly populated matrices may also preferably be employed in a very efficient calculation. One preferred value is that the base function coefficients employed for weighting together include 90% of the energy contained in an entire window for windowing a base function.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principles of the invention. Other embodiments of the present invention and many of the intended advantages of the present invention will be readily appreciated as they become better understood by reference to the following detailed description. The elements of the drawings are not necessarily to scale relative to each other. Like reference numerals designate corresponding similar parts.

These and other objects and features of the present invention will become clear from the following description taken in conjunction with the accompanying drawings, in which:

FIG. 2 is a tabular representation for the comparison of a variable spectral representation to a constant spectral representation;

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
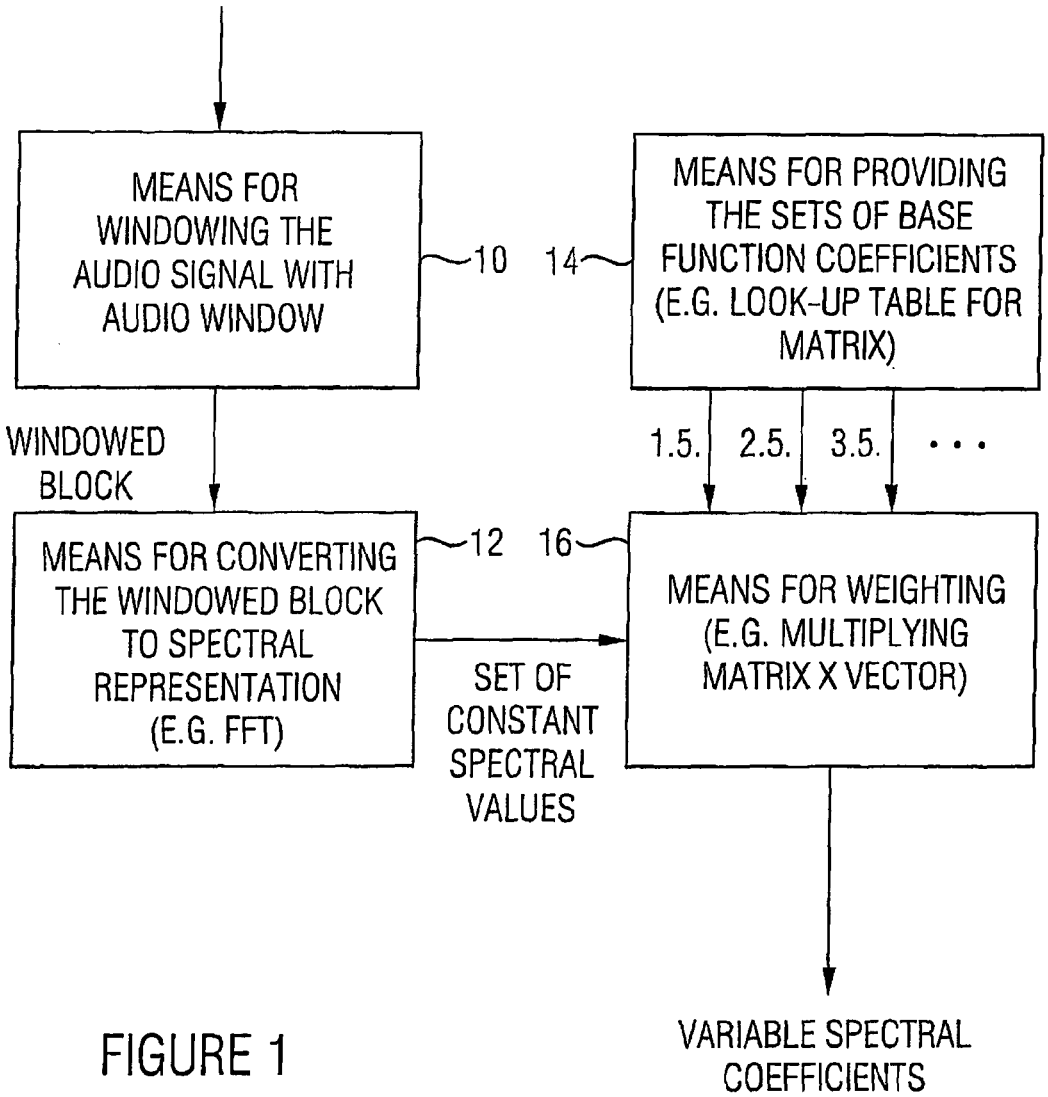
FIG. 1 is a block circuit diagram of a preferred apparatus for converting an audio signal.

FIG. 1 shows a preferred embodiment of an apparatus for converting an audio signal, which is given as a series of samples, to a spectral representation with variable spectral coefficients, wherein a frequency value and a bandwidth are associated with each variable spectral coefficient, wherein the bandwidth of the variable spectral coefficients is variable, and wherein a spacing of the frequency values of the variable spectral coefficients is variable. The inventive apparatus in FIG. 1 includes a means 10 for windowing the audio signal with an audio window function, in order to obtain a windowed block of the audio signal, which has a predetermined length in time. The predetermined length in time is preferably determined by the fact that the window, in terms of time, is long enough so that the frequency resolution set by the window is so great that the lowest tones in the spectrum are obtained with sufficient resolution. As it has been set forth, the resolution required for the musical analysis is 6% of the center frequency. Hence, in order to be able to resolve two tones, the window length should be so great that a frequency resolution equal to about 3% of the lowest frequency sought in the variable spectral representation is obtained. If the lowest tone sought lies at 46.0 Hz, the window should be so long that a resolution of 1.38 Hz is obtained. But since such low tones only rarely occur, so that minor resolution errors are not so critical here for these very low tones, a temporal window length of 256 ms will be sufficient, which corresponds to a frequency resolution of 1.95 Hz.

The windowed block of samples is supplied to a means 12 for converting the windowed block to a spectral representation, which has a set of complex spectral coefficients, wherein for efficiency reasons a conversion rule providing a set of complex constant spectral coefficients is preferred, wherein the frequency values of these constant spectral coefficients have a constant bandwidth and/or a constant frequency spacing.

The apparatus according to the invention further includes a means 14 for providing the sets of base function coefficients. The means 14 preferably is formed as a lookup table, in which a matrix is filed, wherein the matrix coefficients can be referenced by their line/column position of the lookup table. In particular, the means 14 for providing is formed to provide at least a first set of base function coefficients, a second set of base function coefficients and a third set of base function coefficients, wherein the base function coefficients according to the invention are complex base function coefficients. In particular, a first set of base function coefficients represents a result of a first windowing and a first transform of a first base function. The first base function has a frequency corresponding to a first frequency value of a first variable spectral coefficient. As will be explained later with reference to FIG. 4, the first base function could be a sine function with a frequency of e.g. 131 Hz.

The base function coefficients of the second set of base function coefficients are a result of a second windowing and a second transform of a second base function. The second base function is, for example, a sine function with a frequency of 277 Hz, when reference is again made to FIG. 4.

The third set of base function coefficients in turn represents a result of a third windowing and transform of the second base function, i.e. the base function that is a sine signal at a frequency of 277 Hz, for example.

Figure 4:
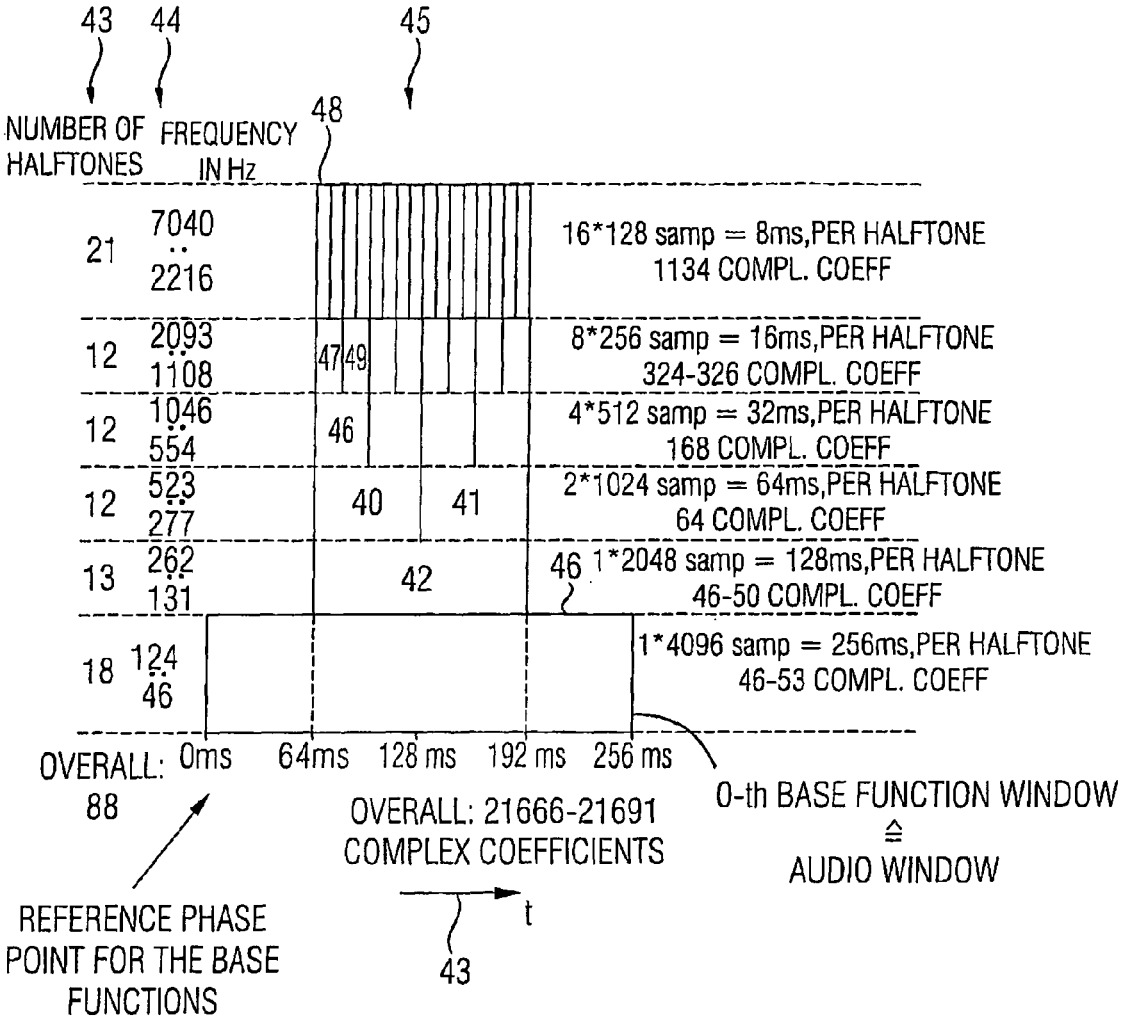
FIG. 4 is a schematic illustration of a preferred embodiment for determining a variable spectral representation in variable spectral coefficients from about 46 Hz to 7040 Hz.

The first, the second and the third windowing differ in that a window length in the first windowing is different as compared with a window length in the second windowing and in the third windowing, wherein, in the example shown in FIG. 4, the window length for windowing the first base function preferably is twice as great as the window length for windowing the second base function. Broadly stated, a window for the first windowing will be longer than a window for the second windowing or for the third windowing.

According to the invention, the window positions of the windows in the second and in the third windowing also are different from each other, so that the third window provides a temporally later portion of the second base function than the second window for windowing the second base function. Thus, in the embodiment shown in FIG. 4, the right rectangle 41 would be the third window, whereas the left rectangle 40 is the second window, and whereas the first window 42 has the same window length as the second window 40 and the third window 41 together, when a direction from left to right in FIG. 4 is assumed as time axis 43.

The apparatus according to the invention, as it is illustrated in FIG. 1, further includes a means 16 for weighting the set of complex spectral coefficients, as they are output from the means 12, with a first set of base function coefficients, in order to calculate the first variable spectral coefficient, and for weighting the complex spectrum with the second set of base function coefficients, in order to obtain the second variable spectral coefficient for a first portion of the audio window, and for weighting the audio spectrum with the third set of base function coefficients, in order to calculate the second variable spectral coefficient for a second portion of the original audio window.

By the fact that the audio spectrum preferably is a complex spectrum, i.e. includes phase information of the spectral values, and by the fact that the base function coefficients are also complex coefficients including phase information of the base function within the window for calculating the base function coefficients, it is achieved according to the invention that the second variable spectral coefficient is calculated with higher time resolution than the first variable spectral coefficient, or that with one and the same complex audio spectrum a first (small) temporal resolution is obtained for the lowest variable spectral coefficient, while for the second variable spectral coefficient already two variable spectral coefficients, which are successive in time, are obtained—on the basis of one and the same audio spectrum—, so that the second variable spectral coefficient thus is obtained with a second temporal (high) resolution.

Furthermore, due to the fact that the third window for windowing the second base function and the second window for windowing the second base function are shorter, i.e. have a shorter window length than the first window for windowing the first base function, the bandwidth of the second variable spectral coefficient will be lower, both at a point earlier in time and at a point later in time, than the bandwidth associated with the first variable spectral coefficient, so that the second and the first variable spectral coefficient have a variable window resolution.

Subsequently, with reference to FIG. 3, the procedure for calculating the sets of base function coefficients will be illustrated. In the topmost diagram of FIG. 3, there is a first not drawn base function, which for example is a sine function at a frequency of 131 Hz, and thus represents the lowest tone of the second group of a plurality of groups of tones (frequency values) of the embodiment shown in FIG. 4. It starts with a defined phase, e.g. the phase 0, at a reference point 30 and extends along the t axis of the topmost diagram of FIG. 3. This first base function is windowed with a first base function window, so that the—phase-correct—excerpt of the first base function is obtained from the window beginning 30 to the window end 31. Following the transform of this excerpt, preferably with an FFT or in general with a transform providing complex spectral values, the first set of base function coefficients is obtained.

Figure 3:
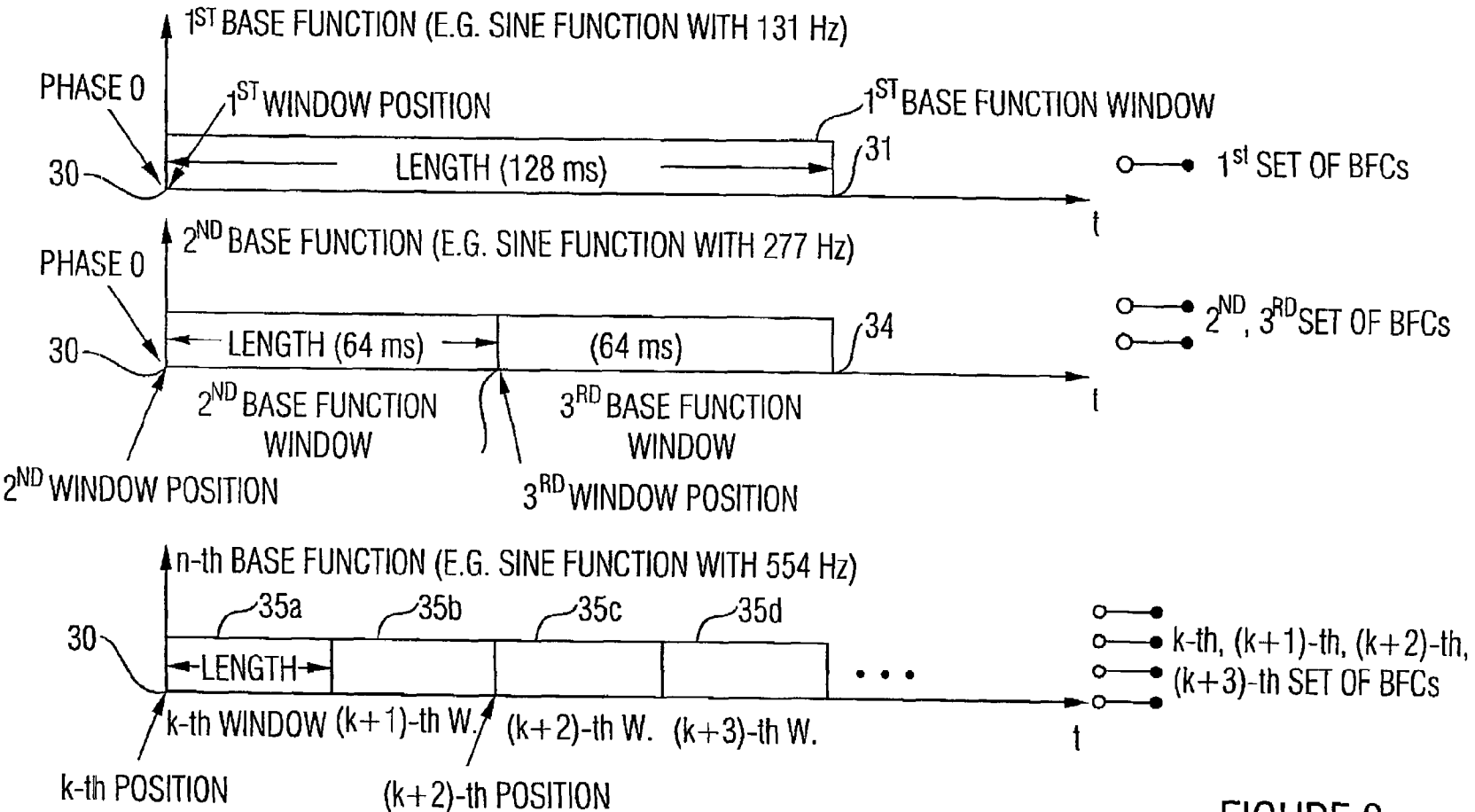
FIG. 3 is a schematic illustration for the explanation of the calculation of the base function coefficients from the base functions.

Furthermore, in the middle diagram, FIG. 3 shows a second base function (not shown), which is a sine function with a frequency of 277 Hz, for example, when the implementation example hinted at in FIG. 4 is considered. The second base function again starts at the starting point 30 preferably with the phase 0 or in general in a defined phase relation to the first base function and extends along the time axis t in arbitrary length. Windowing the second base function with the second base function window, which starts at the second window position and ends at the third window position, i.e. at the point 33, provides a complex second set of base function coefficients, which takes into account at which phase location the two base functions pass the third window position 33. The third base function window has its start at the time instant 33 or is represented by the third window position, when the beginning of the window is taken as window position. As window position, however, also any predetermined point e.g. in the middle of the window or at the end of the window could be taken. The third base function window preferably is arranged immediately after the second base function window and obtains, on the input side, the second base function with a phase location very likely to be different from 0, wherein the second base function further passes through the end 34 of the third base function window again with a certain phase. By transform into a complex spectrum, the third set of base function coefficients is obtained, wherein the information of with which phase the second base function has entered/exited the third base function window is contained in the phases of the base function coefficients of the third set.

In FIG. 3, another case for the n-th base function is further shown in the lower line. Again with reference to the example in FIG. 4, the n-th base function could for example be the base function at 554 Hz, which again preferably starts at the starting point 30, which is aligned with the starting point of the first base function and of the second base function, starts with the phase 0 or with a predetermined phase and extends along the time axis in FIG. 3. The first window 35*a* provides a first excerpt of the n-th base function, in order to provide the k-th set of base function coefficients. Correspondingly, a window 35*b* provides the following portion of the base function, whereas a window 35*c* provides again the following portion of the base function, and whereas a window 35*d* provides again the following excerpt of the n-th base function. In particular, it is to be pointed out that the base function in the middle and the lower illustration in FIG. 3 does not start anew at every window beginning or at every window position, but at the starting position 30, which is aligned among all base functions, and then extends along the time axis, independently of the fact whether a window end has been reached or not, according to the function rule, such as the sine function.

Since the length of the second base function window and of the third base function window each are equal, the second base function window and the third base function window provide a second and a third set of base function coefficients, which have the same spectral resolution, which is, however, smaller than the resolution of the first set of base function coefficients, but which is greater than the resolution of e.g. the k-th set of base function coefficients, which is obtained by windowing the n-th base functions with the window 35*a* in FIG. 3. For this reason, the variable spectral coefficients, which are obtained by weighting the spectrum of these various sets of base function coefficients, have a resolution corresponding to the window with which the base function has been windowed. According to the invention, the resolution thus is no longer determined by the resolution of the original FFT, but by the resolution of the base function window. The FFT for transforming the windowed block of the audio signal only sets the maximum spectral resolution. If a base function window is shorter than the audio window, the frequency resolution is set by the base function window. In this respect, it therefore is preferred to choose all base function windows either equal to or shorter than the audio window.

Subsequently, with reference to FIG. 4, a preferred embodiment of the present invention for music analysis will be illustrated. In the left column 43, the overall 88 halftones are illustrated, which can be analyzed by the embodiment shown in FIG. 4. The halftones represent frequency values of variable spectral coefficients and cover a frequency range with 7.3 octaves or—expressed in Hz—a frequency range from 46 Hz to 7040 Hz, as it is illustrated in a second column 44 of FIG. 4. In the middle column 45 of FIG. 4, the positions/lengths of the base functions windows are illustrated. In contrast to the base function windows of FIG. 3, in FIG. 4 also a 0-th base function window 46 is illustrated, which is arranged such that its window beginning at 0 ms is not aligned with the window beginning of the first base function window 42, wherein the first base function window has a window beginning or a window position of 64 ms. Moreover, the window end of the 0-th base function is not identical with the window end of the first base function window 42, but extends 64 ms beyond the same.

Preferably, all base functions, i.e. all sine functions with frequencies from 46 Hz to 7040 Hz, start with the phase 0 at one and the same reference point for the base functions, which lies at 0 ms in the embodiment shown in FIG. 4. As it is shown in FIG. 4, however, the window beginnings of the 0-th base function window and of the first base function window 42 are not identical. Instead, the first base function window 42, the second base function window 40, a third base function window 46, an eighth base function window as well as a sixteenth base function window 48 indeed start with the same window position among themselves, but 64 ms later than the 0-th base function window. This means that the base functions for all variable spectral coefficients sought, which all start with the reference phase at the point with 0 ms, enter the windows 42, 40, 46, 47, 48 with any phase, but this phase being covered by the complex base function coefficients, which result due to the windowing and transform, in the base function coefficients.

The variable spectral coefficients for the frequencies from 46 Hz to 124 Hz, which represent the first eighteen halftones, therefore act for a time region of the audio signal from 0 ms to 256 ms, since the 0-th base function window preferably coincides with the audio window. The variable spectral coefficients for the frequency values 131 Hz to 262 Hz refer to a range of the audio signal from 64 ms to 192 ms.

Due to the fact that the second base function window 40 and the third base function window 41 are only half as long as the first base function window 40, one variable spectral coefficient for the time portion from 64 ms to 128 ms as well as a second spectral coefficient for the excerpt 128 ms to 192 ms results for each frequency of the frequencies 277 to 523.

For each of the variable spectral coefficients for the frequency values 554 Hz to 1046 Hz, again four variable spectral coefficients each result, wherein the first variable spectral coefficient for e.g. the frequency of 554 Hz refers to the portion of the audio signal between 64 ms to 96 ms. The second variable spectral coefficient, which goes back to the next window 49, refers to the excerpt between 96 ms and 128 ms of the original audio signal. The further variable spectral coefficients e.g. for the frequency value 1108 Hz result for the corresponding later excerpt in analog manner.

For a group of e.g. the topmost 21 halftones, which cover the frequencies between 2216 Hz and 7040 Hz, it is preferred to take windows with a window length of 8 ms each, so that 16 such short windows 48 fit in a long first base function window 42.

It is to be pointed out that the base function coefficients obtained by the window arrangement, as it is schematically shown in FIG. 4, are preferably stored in a matrix, as it will be explained with reference to FIG. 5. Then, the weighting, which is performed by the means 16 of FIG. 1, becomes a simple matrix multiplication of the complex spectrum, which is obtained by windowing the audio signal with preferably the 0-th base function window, a simple matrix multiplication, wherein the coefficient matrix, i.e. the matrix in which the sets of the base function coefficients are stored, will additionally be very thinly populated. According to the invention, by a single transform of the audio signal and by a single matrix-vector multiplication, hence a variable spectral representation of the audio signal is obtained, which provides complete spectral information for each time portion of 8 ms, i.e. for every length of the shortest window 48. Thus, the variable spectral coefficients for the lowest two halftone groups from 46 Hz to 262 Hz will indeed be identical for all 16 spectrums with a length of 8 ms. But for the frequencies between 2216 and 7040 Hz a new spectrum results at every 8 ms.

In other words, the variable spectral coefficients, which go back to a base function window that is longer than another window, are "reused" for the spectrums resulting due to shorter base function windows. With reference to FIG. 4, this means that the spectrums resulting due to a base function window of a lower line in FIG. 4 are "reused" for all—mutually different—spectrums resulting for base function windows of a higher line in FIG. 4.

This "recycling" of variable spectral coefficients due to longer base function windows does, however, correspond to the natural laws of time/frequency resolution, because—stated simply—a period of a signal with low frequency is longer than a period of a signal with high frequency.

The inventive concept thus provides, using only a single FFT as well as a single multiplication with a pre-stored, very thinly populated matrix, 16 variable spectrums, with each spectrum having a length of 8 ms, such that with this a complete—gap-free—region of the audio signal with a length of 128 ms is analyzed with high time resolution and high frequency resolution. For the same example, the bounded Q analysis mentioned at the beginning would require 96 (!) complete Fourier transforms.

It is to be pointed out that the base function window does not necessarily have to be offset with respect to all other base function windows. Instead, the window beginning of the 0-th base function window could also be aligned with the window beginning of the first base function window, etc. In this case, it would furthermore be preferred to mirror the entire window arrangement at a vertical line starting with the tone at 131 Hz, so that the first base function window 42 would have a downstream further base function window of equal length, while now four base function windows of equal length would be in the line with the base function windows 40 and 41.

The arrangement of the upper base function windows in centered manner above the lower base function window shown in FIG. 4 is, however, preferred in that the original audio signal is not analyzed with successive audio windows, but with audio windows having an overlap. As preferred overlap, an overlap of 50% is chosen.

Figure 6:
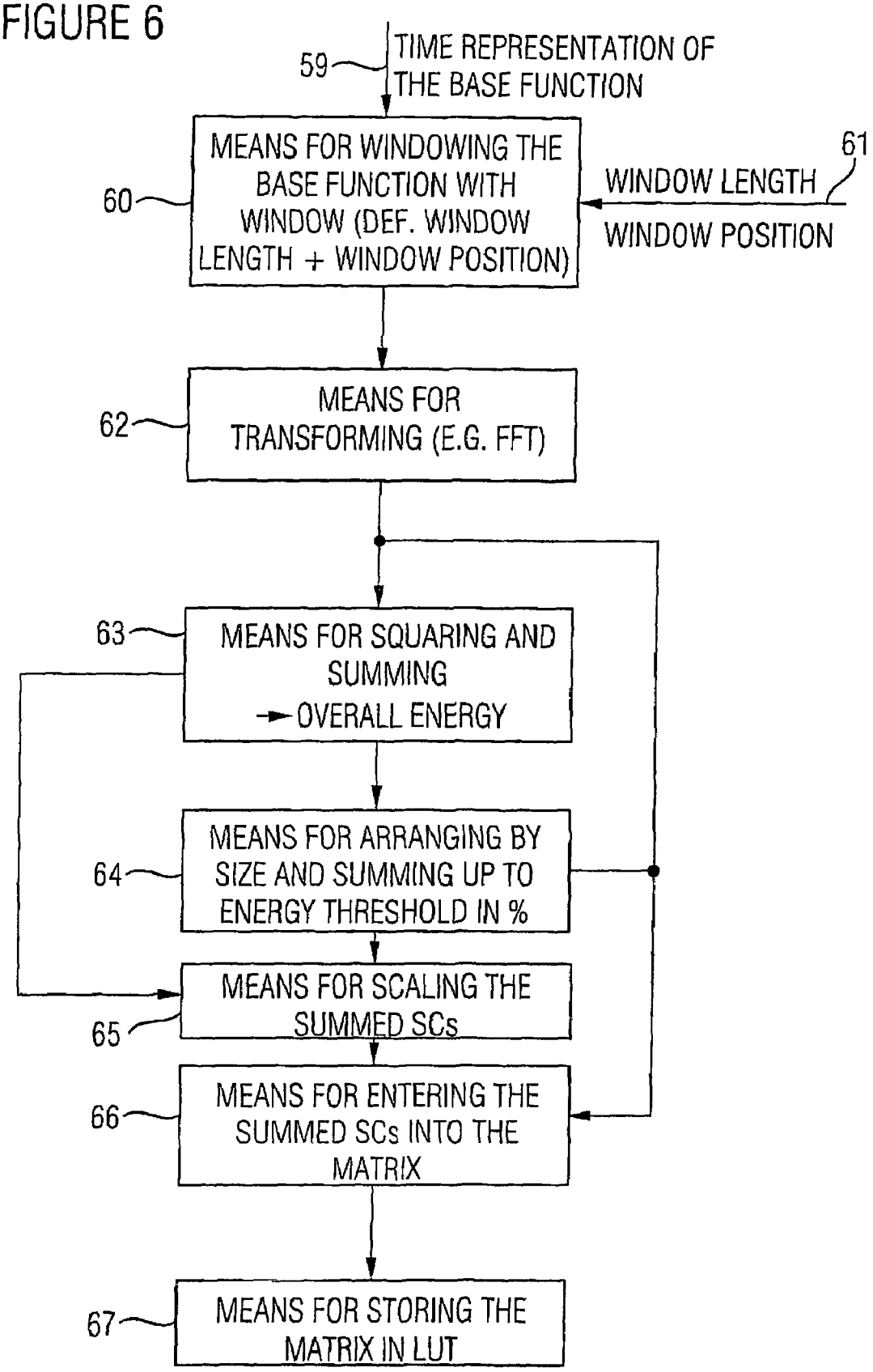
FIG. 6 is a block circuit diagram of an apparatus for calculating the sets of base function coefficients for various frequency values and various (successive) windows, according to the invention.

Subsequently, with reference to FIG. 6, a preferred embodiment of the means for providing the sets of base function coefficients will be illustrated, when the means for providing is formed so as to generate the base function coefficients from the original base functions present in time representation. At first, a base function is supplied to a means 60 for windowing the base function with a window, wherein the window has a defined window length and window position, as they are directed by a window length/window position control 61. Hereupon, the windowed block of the base function is supplied to a means 63 for transforming, wherein the FFT algorithm is preferred as transform algorithm. It is to be pointed out that the calculation shown in FIG. 6 does not necessarily have to be highly efficient, since it can be executed in advance, to determine the coefficient sets off-line.

Typically, the result of the transform in the block 62 will be a spectrum having few prominent lines and many minor lines, wherein the few prominent lines are to be attributed to the fact that the frequency value of a variable spectral coefficient will not necessarily match the resolution achieved by the transform 62. Furthermore, coefficients are also generated due to the fact that the base functions do not necessarily have to enter the window with the phase 0 and not necessarily have to exit the window with the phase 0. Moreover, the windowing itself also leads to artifacts, which are, however, uncritical. Furthermore, some compensation of the artifacts exists when the same window shape is employed as audio window and as base function window. It has turned out that the simplest window to be handled numerically, i.e. the rectangular window, has provided the best results according to the invention.

So as to have defined conditions, then a selection is performed among a set of base function coefficients. To this end, the spectrum is fed to a means 63 squaring each spectral value, i.e. each base function coefficient, so as to then sum the squared base function coefficients in order to obtain a measure for the overall energy. Hereupon, the spectrum is fed to a means 64 for arranging the spectral coefficients according to their size and for summing starting from the greatest toward the smallest value, wherein this summing is continued until a predetermined energy threshold in percent is reached. Thus, then only the spectral values that have been summed continue to be used as base function coefficients, whereas the spectral values that have no longer taken part in the summing, are set to 0 in defined manner, in order to further thin out the coefficient matrix, which will be described later. Hereupon, the summed spectral coefficients, i.e. the spectral coefficients having taken part in the summing and having contributed to the 90% measure of energy are fed to a means 65 for scaling the summed spectral coefficients, such that in the end the base function coefficients in each set of base function coefficients together have the same energy. With this, the fact that of course a base function brings substantially more energy into a long window than into a short window is offset. So as to obtain no artifacts therefrom, the energy of each set of base function coefficients is therefore made equal within a predetermined deviation threshold of e.g. 50%, and preferably 5%.

Hereupon, the scaled base function coefficients having "survived" the selection step in block 64 are fed to a means 66 for entering into the coefficient matrix, which is finally stored preferably in a lookup table (LUT) by a means 67. In FIG. 6, this procedure—controlled by the window length indicator 61 and the window position indicator as well as for each temporal representation of the base function fed in via the base function input 59—is continued until all 32 sets of base function coefficients (for the embodiment of FIG. 4) for each halftone have been calculated. FIG. 5 shows a typical matrix of the base function coefficients, wherein a set of base function coefficients is entered in every line of the matrix. The matrix is multiplied by a vector having as many columns as frequencies have been obtained by the audio windowing and audio transform. On the output side, variable spectral coefficients for the 88 halftones shown in FIG. 4 result, but in that there are two variable spectral coefficients already for the halftone at the frequency of 277 Hz, whereas there are already four variable spectral coefficients, which concern successive temporal regions, for the variable spectral coefficient at a frequency of 554 Hz.

In the embodiment shown in FIG. 4 and with the corresponding window division, 535 base function coefficient sets are used, wherein furthermore 2048 complex frequency values are calculated, wherein this value is set by the length of the 0-th base function window, into which 4096 real samples are fed. On the right in FIG. 4 it is illustrated how many complex coefficients per "band" "survive" the selection process illustrated with reference to FIG. 6. In the lowest region about 2 to 3 complex coefficients for each of the 18 halftones survive. For the second band, almost four complex coefficients each survive for each of the halftones from 131 Hz to 262 Hz. In the next band it is already 14 complex coefficients per halftone. In the topmost band, there are 1134 complex coefficients surviving the selection process for the 21 halftones, which means that already 54 complex spectral coefficients per halftone survive. This means that 21666 to 21691 complex coefficients exist, as it is shown in FIG. 4. But the coefficient matrix nevertheless is only populated with 1.98%, as it is illustrated in FIG. 5.

Figure 5:
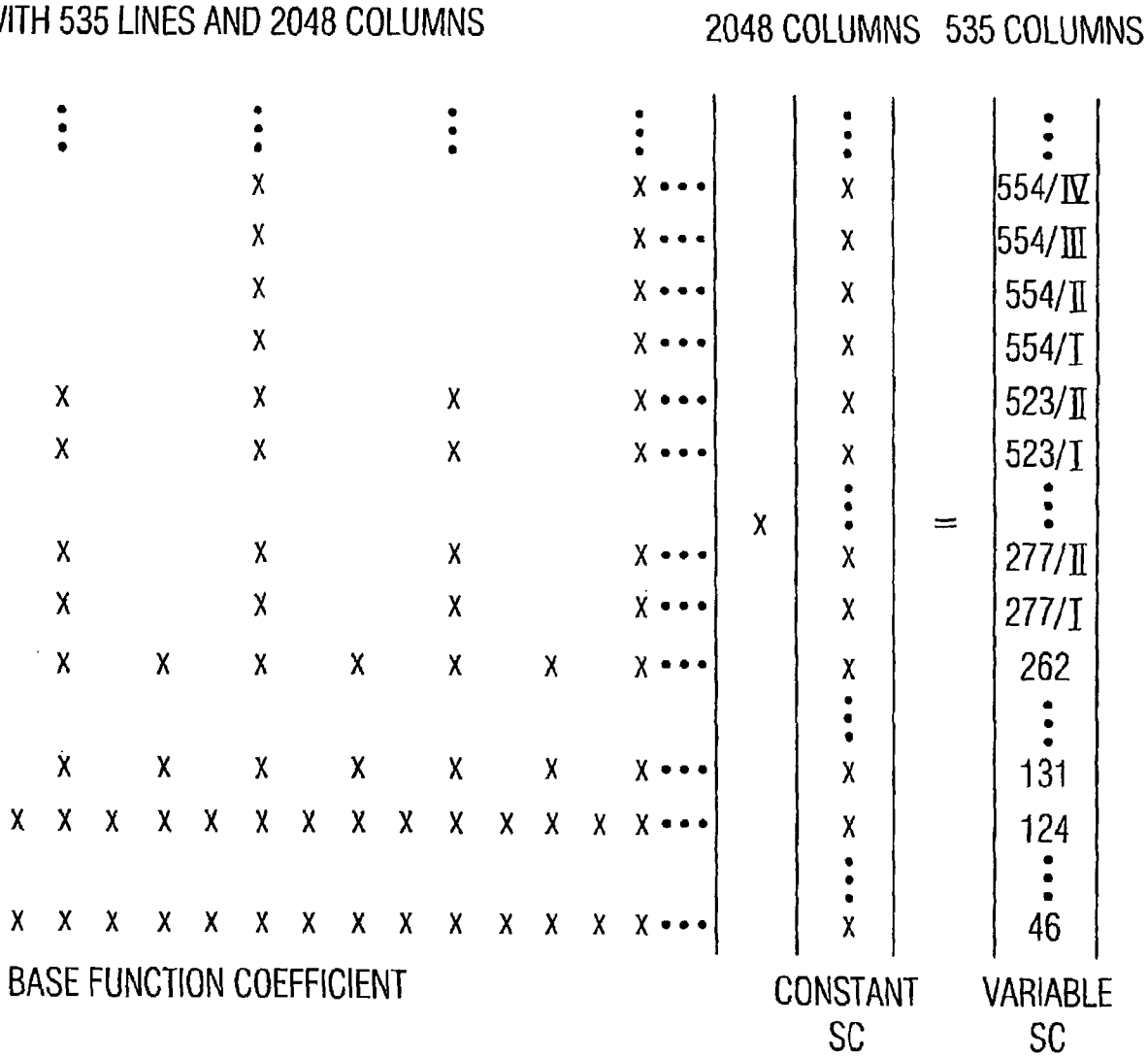
FIG. 5 is a schematic illustration of a portion of a preferred matrix representation for the embodiment shown in FIG. 4.

At this point, it is to be pointed out that the crosses in FIG. 5 represent the positions at which any value at all can exist per coefficient set. Thus, the frequency resolution due to the 0-th base function window is twice as high as the frequency resolution due to the first base function window 42. For this reason, in the column for the halftone at 131 Hz, in principle only at most every second position of the matrix is occupied with reference to e.g. the column for the halftone at 124 Hz. For the next band, which starts at 277 Hz, again only at most every fourth point in a line of the matrix is occupied. In the next band, which starts at 554, every eighth value at the most is occupied in the matrix due to the again reduced frequency resolution, etc.

It is to be pointed out once again that the crosses in FIG. 5 only illustrate where any value can be at all. The selection process, however, leads to the fact that the fewest possible spots in the matrix are populated with actual values unequal 0 anyway. The actual appearance of the matrix will therefore look almost inverse to the illustration of the population "possibilities" of the matrix, as it is sketched in FIG. 5, due to the fact that the upper bands have more spectral coefficients.

The inventive concept concerns a range of 88 halftones more specifically between 46.3 Hz ($F_1$ Sharp) and 7040 Hz ($A_8$) with window sizes from 256 ms to 8 ms. For the lowest frequencies, as it has been illustrated, a temporally overlapped analysis window of 50% is used, with which a maximum frame increment of 128 ms for the system results. This property of course generates more output values for higher frequencies, when the samples of the input signal are analyzed without gaps. A practical solution for this mismatch is a sample and hold automatism, which is used for the lower frequency output values, whereby the matrix representation (FIG. 5) of the complete, transformed signal can be achieved. In other words, this represents the recycling of the variable spectral coefficients for lower frequencies, in order to obtain high-resolution complex spectrums with high time resolution.

In particular, the inventive concept is characterized by the fact that the computationally more efficient rectangular windows are employed, instead of the more intensive Hamming windows. Furthermore, in a preferred embodiment of the present invention, a complete analysis is achieved at a 50% overlap, wherein particularly the inventive matrix structure illustrated on the basis of FIGS. 4 and 5 is preferred.

The inventive concept is characterized by a block-wise constant window length, and thus by a quality factor, which varies within a band (of FIG. 4), but which is "readjusted" again from band to band due to the different windows for calculating the base function coefficients. The matrix-vector multiplication operation may particularly be made more efficient by the fact that the criterion for the reduction of the coefficients is applied, namely in that only the coefficients with the most energy survive, the sum of which amounts to for example 90% of the energy of an entire coefficient set. By energy scaling it is furthermore ensured that each set of base function coefficients has almost the same energy, so that the correlation achieved by the base function coefficients is equally effective for all variable spectral coefficients.

At this point, it is to be pointed out that the examination time window, i.e. the audio signal window, refers to a signal portion of the time signal to be analyzed. This time signal is multiplied by a rectangular window of 256 ms width in the time domain and transformed to the frequency domain by FFT, where then the exact analysis takes place using the CQT coefficients or base function coefficients. The rectangular window is moved on by 50% of its width each, i.e. 128 ms, before the next FFT is calculated. Each sample in the time domain thus enters the FFT twice. The width of the rectangular window is determined by the intended high resolution at these frequencies. Since the demands on the frequency resolution decrease, however, toward higher frequencies, a smaller window width also is sufficient there.

The modified CQT at this point takes advantage of the phase information of the coefficients, in order to enable more accurate location of the spectral proportions within the audio window. In other words, for rectangular windows a different number of frequency values result independently of the frequency range, namely exactly one value for the lowest frequency range, wherein each sample is used twice here by the 50% overlap, also exactly one value for the next higher range, wherein only the half of the samples centered around the window center is used. For the next higher range, exactly two values result, wherein only the second or third quarter of the samples is used, etc. It is preferred to illustrate the overall result of the transform in matrix form. Since there is a different number of values for the same analysis part depending on the frequency range, which is the feature of the present invention with respect to the high time resolution, a repetition or a "recycling" of the values from the lower frequency ranges is performed to indicate a complete spectrum for every smallest window.

With respect to the selection of the base function coefficients, it is to be pointed out that starting from the highest values per line, i.e. per analysis bin, the quotients are squared and summed until the threshold of 90% of the greatest square sum occurring in the entire matrix or matrix line is reached. The remaining quotients of each line are set to 0. The remaining coefficients are then normalized line by line to achieve uniform weighting of the lines.

A preferred application of the inventively generated variable spectral representation lies in the music analysis and particularly in the transcription, i.e. the note finding, or for purposes of key recognition or chord detection, or generally wherever a frequency analysis with variable bandwidth for the spectral coefficients is required. Further fields of application therefore are given for the transform of, generally speaking, information signals, which are video signals, but also temporal measurement values or temporal simulation courses of an electric or electronic parameter, the frequency representation of which with high time and high frequency resolution is of interest.

Finally, it is to be pointed out that the inventive concept may be implemented as hardware, software or as a mixture of hardware and software. The present invention thus also relates to a computer program with a machine-readable code by which one of the methods according to the invention is executed when the computer program is executed on a computer.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. An apparatus for converting an information signal to a spectral representation, comprising:

a window filter configured for windowing the information signal given as a series of samples to obtain a windowed block of the information signal having a length in time;

a converter configured for converting the windowed block of samples to a spectral representation having a set of information signal spectral coefficients;

a provider configured for providing a first set of complex base function coefficients, a second set of complex base function coefficients and a third set of complex base function coefficients, wherein the base function coefficients of the first set represent a result of a first windowing and transform of a first base function, which has a frequency corresponding to a first frequency value of a first variable spectral coefficient of the spectral representation, the spectral representation comprising variable spectral coefficients, frequency values and bandwidths being associated with the variable spectral coefficients, wherein a frequency spacing of the variable spectral coefficients is variable, wherein the base function coefficients of the second set represent a result of a second windowing and transform of a second base function, which has a frequency corresponding to a second frequency value of a second variable spectral coefficient of the spectral representation, and wherein the base function coefficients of the third set represent a result of a third windowing and transform of the second base function, which has the second frequency value, wherein the first windowing, the second windowing and the third windowing differ in that a window length of a window in the first windowing differs from a window length of a window in the second and the third windowing, and that a window position of the second window and of the third window differ with reference to the second base function; and a weighter configured for weighting the set of information signal spectral coefficients with the first set of base function coefficients, in order to calculate the first variable spectral coefficient of the spectral representation, for weighting the set of information signal spectral coefficients with the second set of base function coefficients, in order to obtain the second variable spectral coefficient of the spectral representation comprising variable spectral coefficients for a first portion of the windowed block of the information signal, and for weighting the set of information signal spectral coefficients with the third set of base function coefficients, in order to obtain the second variable spectral coefficient of the spectral representation comprising variable spectral coefficients for a second portion of the windowed block of the information signal, the second portion of the windowed block of the information signal being different from the first portion of the windowed block of the information signal.

2. The apparatus of claim 1, wherein the information signal is an audio signal with music information and the variable spectral coefficients have frequency values that are halftones of a note system.

3. The apparatus of claim 1, wherein the weighter is configured for performing a multiplication of a matrix comprising the first, second, and third sets of base function coefficients by a vector comprising the information signal spectral coefficients.

4. The apparatus of claim 1, wherein the window filter is formed to use a rectangular window as audio window.

5. The apparatus of claim 1, wherein the windows for the first windowing, the second windowing and the third windowing for determining the base function coefficients are rectangular windows.

6. The apparatus of claim 1, wherein a window length of a window for determining the second set of base function coefficients and a window length of a window for determining the third set of base function coefficients are equal and half as long as a window for determining the first set of base function coefficients.

7. The apparatus of claim 1, wherein the provider is formed to provide further sets of base function coefficients, which represent the results of further widowing operations of further base functions, and the number of which is twice as large as a number of sets of base function coefficients for a base function with a lower frequency value.

8. The apparatus of claim 1, wherein the provider is formed to provide a further set of base function coefficients for a further base function having a lower frequency value than the frequency value of the first base function, wherein a further window for windowing the further base function is longer than the window for determining the first set of base function coefficients and has a window position different from a window position of the window for determining the first set of base function coefficients.

9. The apparatus of claim 8, wherein all base functions have the same reference phase, which is in a predetermined ratio to a window position of the further window.

10. The apparatus of claim 8, wherein the window position of an audio window for windowing the information signal coincides with the window position of the further window, and wherein the window filter is formed to window the information signal in overlapping manner.

11. The apparatus of claim 1, wherein the window filter is formed to window the information signal so that a window position of an audio window coincides with a window position of a window for determining the first set of base function coefficients and of a window for determining the second set of base function coefficients.

12. The apparatus of claim 1, wherein the provider is configured for providing, in a set of base function coefficients, only such base function coefficients that satisfy a criterion, and for setting to zero the base function coefficients not satisfying the criterion.

13. The apparatus of claim 12, wherein the provider is configured to apply the criterion, wherein the criterion is given by the fact that a base function coefficient satisfying the criterion, summed with other base function coefficients also satisfying the criterion, is needed to achieve a predetermined percentage of an overall energy of all base function coefficients.

14. The apparatus of claim 1, wherein the provider is configured for providing the set of base function coefficients as a result of a selection, the provider being configured for performing the selection, wherein the selection at first includes a squaring and summation of all base function coefficients obtained by windowing and transform, and wherein the summation further includes a summation with reference to the size of the squared base function coefficients starting from the greatest base function coefficient, until a summed value has a predetermined percentage of a summed value for all base function coefficients obtained by windowing and transform.

15. The apparatus of claim 14, wherein the provider is configured for providing a set of base function coefficients as a result of a scaling, wherein all base function coefficients satisfying the predetermined criterion are weighted by the provider with the result of the summation of all base function coefficients obtained by windowing and transform.

16. The apparatus of claim 1, wherein a window for determining the third set of base function coefficients immediately follows a window for determining the second set of base function coefficients.

17. The apparatus of claim 1, wherein the converter is formed to provide complex spectral coefficients as the set of information signal spectral coefficients.

18. The apparatus of claim 1, wherein the converter is formed to perform a fast Fourier transform.

19. The apparatus of claim 1, wherein the provider is formed to provide sets of base function coefficients so that windows for providing the sets of base function coefficients all have a length that is an integer fraction of a window length of a window for determining the first set of base function coefficients.

20. The apparatus of claim 1, wherein the provider is formed to provide the first set of base function coefficients as a result of a windowing with the first window, which has a temporal length of 128 ms, and wherein the provider is further formed to provide the second set of base function coefficients and the third set of base function coefficients as a result of a windowing with a window having a length of 64 ms.

21. A method of converting an information signal, which is given as a series of samples, to a spectral representation with variable spectral coefficients, with a frequency value and a bandwidth being associated with a variable spectral coefficient, and with a frequency spacing of the variable spectral coefficients being variable, comprising:

windowing the information signal to obtain a windowed block of the information signal having a length in time;

converting the windowed block of samples to a spectral representation having a set of information signal spectral coefficients;

providing a first set of complex base function coefficients, a second set of complex base function coefficients and a third set of complex base function coefficients, wherein the base function coefficients of the first set represent a result of a first windowing and transform of a first base function, which has a frequency corresponding to a first frequency value of a first variable spectral coefficient, wherein the base function coefficients of the second set represent a result of a second windowing and transform of a second base function, which has a frequency corresponding to a second frequency value of a second variable spectral coefficient, and wherein the base function coefficients of the third set represent a result of a third windowing and transform of the second base function, which has the second frequency value, wherein the first windowing, the second windowing and the third windowing differ in that a window length of a window in the first windowing differs from a window length of a window in the second and the third windowing, and that a window position of the second window and of the third window differ with reference to the second base function; and weighting the set of information signal spectral coefficients with the first set of base function coefficients, in order to calculate the first variable spectral coefficient, weighting the set of information signal spectral coefficients with the second set of base function coefficients, in order to obtain the second variable spectral coefficient for a first portion of the windowed block of the information signal, and weighting the set of information signal spectral coefficients with the third set of base function coefficients, in order to obtain the second variable spectral coefficient for a second portion of the windowed block of the information signal, which is different from the first portion of the windowed block of the information signal.

22. A computer program with a program code for performing, when the computer program is executed on a computer, a method of converting an information signal, which is given as a series of samples, to a spectral representation with variable spectral coefficients, with a frequency value and a bandwidth being associated with a variable spectral coefficient, and with a frequency spacing of the variable spectral coefficients being variable, comprising:

windowing the information signal to obtain a windowed block of the information signal having a length in time;

converting the windowed block of samples to a spectral representation having a set of information signal spectral coefficients;

providing a first set of complex base function coefficients, a second set of complex base function coefficients and a third set of complex base function coefficients, wherein the base function coefficients of the first set represent a result of a first windowing and transform of a first base function, which has a frequency corresponding to a first frequency value of a first variable spectral coefficient, wherein the base function coefficients of the second set represent a result of a second windowing and transform of a second base function, which has a frequency corresponding to a second frequency value of a second variable spectral coefficient, and wherein the base function coefficients of the third set represent a result of a third windowing and transform of the second base function, which has the second frequency value, wherein the first windowing, the second windowing and the third windowing differ in that a window length of a window in the first windowing differs from a window length of a window in the second and the third windowing, and that a window position of the second window and of the third window differ with reference to the second base function; and weighting the set of information signal spectral coefficients with the first set of base function coefficients, in order to calculate the first variable spectral coefficient, weighting the set of information signal spectral coefficients with the second set of base function coefficients, in order to obtain the second variable spectral coefficient for a first portion of the windowed block of the information signal, and weighting the set of information signal spectral coefficients with the third set of base function coefficients, in order to obtain the second variable spectral coefficient for a second portion of the windowed block of the information signal, which is different from the first portion of the windowed block of the information signal.

* * * * *